US009768549B1

(12) United States Patent
Chen

(10) Patent No.: US 9,768,549 B1
(45) Date of Patent: Sep. 19, 2017

(54) SIGNAL CONNECTOR

(71) Applicant: Ching-Fu Chen, Taoyuan (TW)

(72) Inventor: Ching-Fu Chen, Taoyuan (TW)

( * ) Notice: Subject to any disclaimer, the term of this patent is extended or adjusted under 35 U.S.C. 154(b) by 0 days.

(21) Appl. No.: 15/431,848

(22) Filed: Feb. 14, 2017

(30) Foreign Application Priority Data

Feb. 25, 2016 (TW) ..... 105105650 A

(51) Int. Cl.
*H01R 13/595* (2006.01)
*H01R 13/58* (2006.01)

(52) U.S. Cl.
CPC ..... *H01R 13/595* (2013.01); *H01R 13/5825* (2013.01)

(58) Field of Classification Search
CPC .. H01R 24/58; H01R 4/4872; H01R 13/6275; H01R 13/111
USPC ..... 439/669, 668, 817, 357, 841–850
See application file for complete search history.

(56) References Cited

U.S. PATENT DOCUMENTS 2,434,070 A * 1/1948 Gross ..... H01H 51/32 310/34
5,308,266 A * 5/1994 Booker ..... H01R 13/35 439/817
7,699,665 B1 * 4/2010 Yin ..... H01R 13/502 439/669
7,914,342 B2 3/2011 Chen

* cited by examiner

*Primary Examiner* — Phuongchi T Nguyen

(57) ABSTRACT

A signal connector includes a main body and positioning device. The main body has a front section with an end connector and a rear formed by an accommodating groove with a threaded hole and insert hole. The positioning device is received into the accommodating groove of the main body, composed of a clamping piece and screwing elements. The clamping piece is at the bottom of the groove, with a threaded hole. The screwing element is inserted through the insert hole and secured in the threaded hole. After foresaid are combined, the conducting filament of a transmission line can be tightly clamped by the clamping piece by rotating the screwing element to move the clamping piece upward, ensuring enhanced signal transmission.

5 Claims, 6 Drawing Sheets

SIGNAL CONNECTOR

BACKGROUND OF THE INVENTION

1. Field of the Invention

This invention is of a signal connector, which is particular in its ability to firmly and effectively clamp and position a signal transmission line, whilst ensuring protection against damage to the conducting filament of the transmission line, at the same time as offering practicality and convenience.

2. Description of the Prior Art

Conventionally, a signal connector 1 is directly fixed onto a transmission line (A) through threading, facilitated by a screw element (N). As a consequence, the transmission line (A) can be easily positioned within the signal connector 1. However, having the screw element (N) directly screw on to the conducting filament (B) of the transmission line (A) is likely to render the conducting filament (B) broken and damaged, as shown in the expanded section of FIG. 1. As a result, effective signal transmission may be diminished. Therefore, there is clear room for improving the conventional way of joining the signal connector 1 with the transmission line (A).

SUMMARY OF THE INVENTION

The objective of this invention is to provide a signal connector that is able to clamp a signal transmission line firmly, at the same time as ensuring no damage to the conducting filament part of the transmission line.

The signal connector in the present invention is composed of a cylindrical main body. Its interior is formed of a hollow accommodating groove, and at one end a flange and an end connector is provided. A threaded hole and an insert hole are bored into the accommodating groove, and the two sides are formed into a planar shape. A positioning device in the accommodating groove of the main body contains a clamping piece and screwing elements. The clamping piece has a threaded hole at one end, and the clamping piece is a little smaller than the accommodating groove in terms of width. The screwing element is inserted through the insert hole of the main body, and threaded into the threaded hole on the clamping piece. This ensures that the clamping piece is joined with the accommodating groove of the main body.

BRIEF DESCRIPTION OF DRAWINGS

This invention will be understood by referring to the accompanying drawings, wherein.

DETAILED DESCRIPTION OF THE PREFERRED EMBODIMENT

Figure 1:
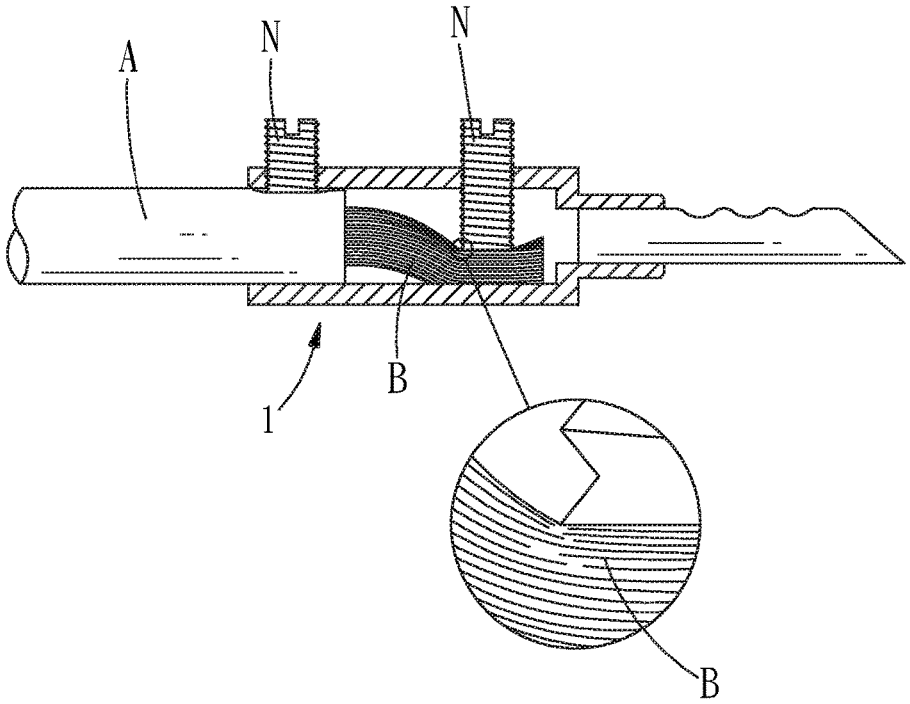
FIG. 1 is a schematic view of a conventional signal connector in a use state.
Figure 2:
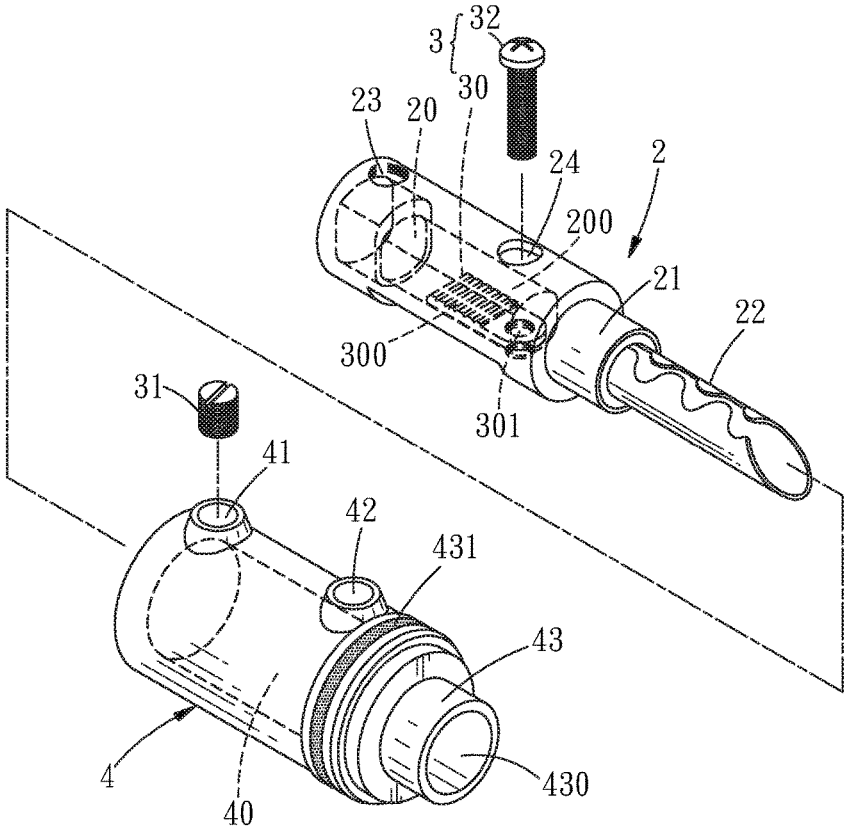
FIG. 2 is an exploded perspective view of a signal connector in the present invention.
Figure 3:
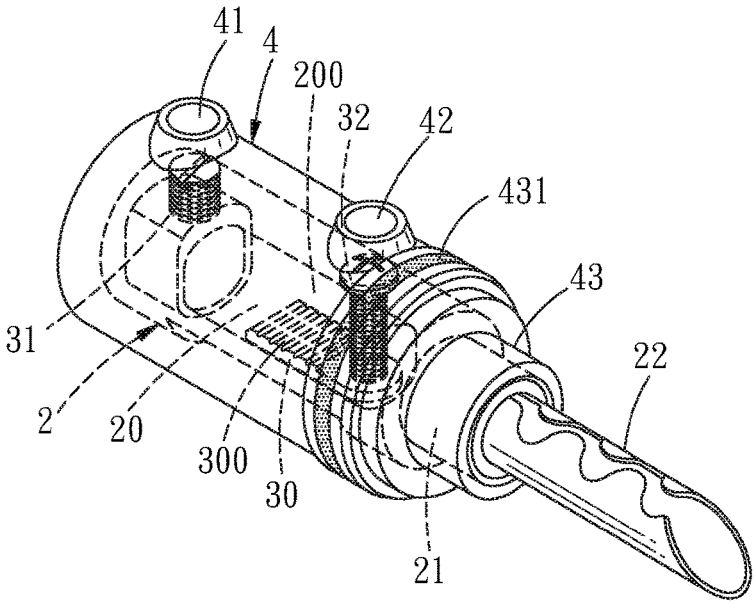
FIG. 3 is a perspective view of the signal connector in the present invention.
Figure 4:
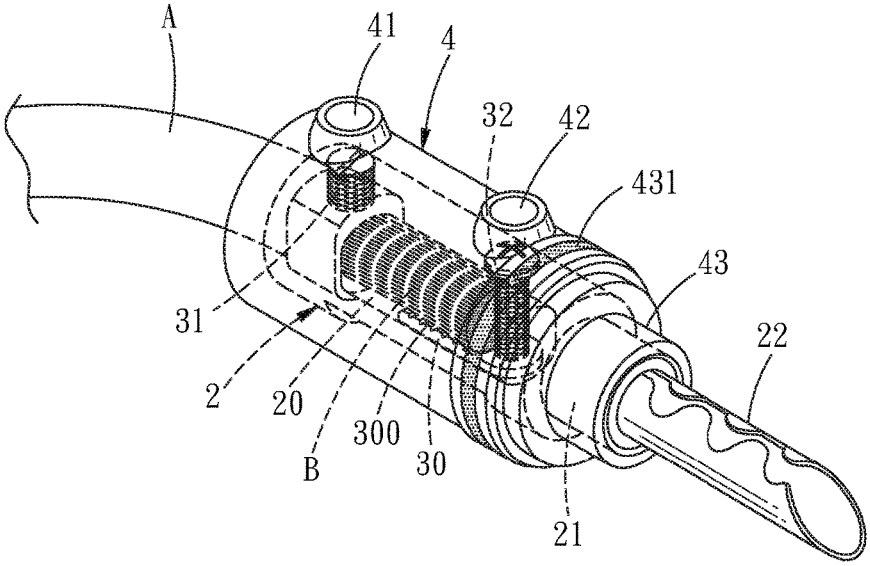
FIG. 4 is a schematic view of the signal connector in the present invention in a use state.
Figure 5:
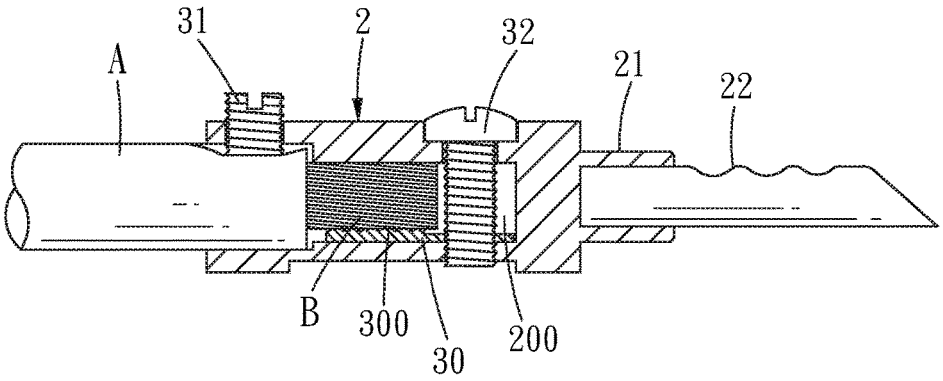
FIG. 5 is a schematic view of the signal connector in the present invention, showing clamping operation of a positioning device.
Figure 6:
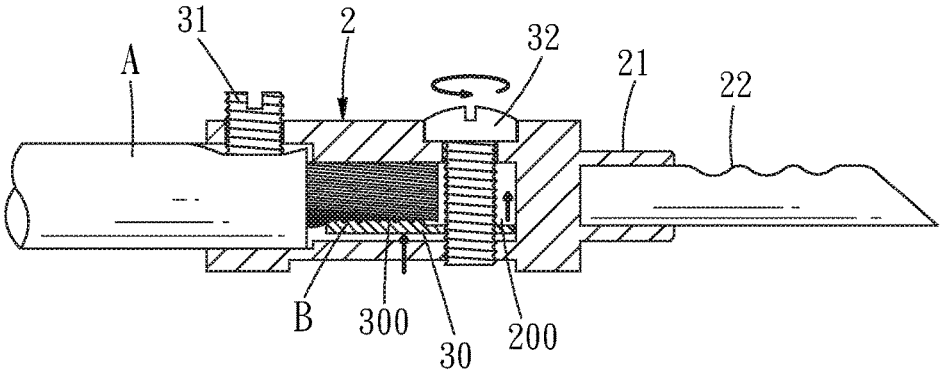
FIG. 6 is another schematic view of the signal connector in the present invention, showing the clamping operation of the positioning device.
Figure 7:
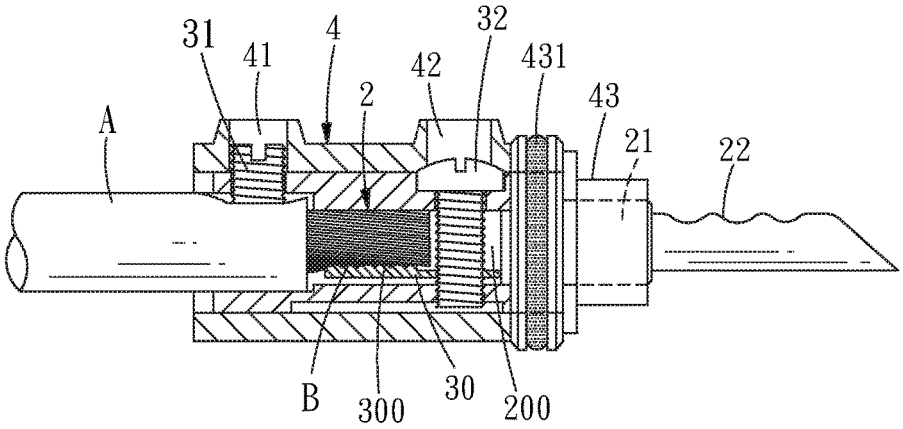
FIG. 7 is a cross-sectional view of the signal connector in the present invention in a use state.

The preferred form of the signal connector in the present invention, is shown in FIGS. 2-7. This includes a main body 2, a positioning device 3, and a sleeve 4 as the main components combined together.

The main body 2 is provided with a hollow rectangular accommodating groove 2. At one end there is a flange 21 and an end connector 22. A threaded hole and an insert hole 24 are bored into the accommodating groove 20, and the two sides are formed into a lifting space 200.

The positioning device 3 is received in the accommodating groove 20 of the main body 2. This consists of a clamping piece 30 and screwing elements 31, 32. The clamping piece 30 can be actuated to move up and down in the lifting space 200 of the accommodating groove 20, and the clamping piece 30 is designed asymmetrically, having a surface provided with non-slip characteristics 300, as well as one end bored with a threaded hole 301. Furthermore the clamping piece 30 is somewhat smaller than the lifting space 200 in width. As a result, the clamping piece 30 can only be moved up and down but cannot be rotated. When the screwing element 32 is inserted through the insert hole 24 of the main body 2 and threaded into the threaded hole 301 of the clamping piece 30 in the accommodating groove 20, the clamping piece 30 can then be steadily positioned in the accommodating groove 20 of the main body 2.

The sleeve 4 wrapped around the outer side of the main body 2 has an accommodating groove 40 on its interior, the shape of which is the same as the main body 2. Furthermore, the accommodating groove 40 of the sleeve 4 is provided with two fish-eye insert holes 41 and 42. The diameter of the fish-eye insert hole 42 is a little smaller than the nut head of the screw element 32. The sleeve 4 has one end made up of a flange 43 with a central insert hole 430 provided with a polar color ring 431.

In using the signal connector of this invention, after a signal transmission line (A) is inserted into the accommodating groove 20 of the main body 2, the screwing element 32 is rotated so that the clamping piece 30 is moved upward and forced to clamp and position with the conducting filament (B) of the transmission line (A) in a planar state. The screwing element 31 is firmly screwed into the threaded hole 23 of main body 2, allowing the clamping piece 30 to tightly clamp the outer skin of the transmission line (A). Thus, the transmission line (A) can be completely fixed into place and the conducting filament (B) cannot be twisted or broken. As a result, it is able to maintain a better signal transmission.

As can be understood from the above description, this invention has the following advantages:

1. This invention uses the clamping piece 30 to move up and press flatly against the conducting filament (B) of the transmission line (A). As a result, the conducting filament (B) will not be broken nor damaged, thus ensuring superior signal transmission.

2. The clamping piece 30 of this invention presses against a large-area on the transmission line (A). Therefore, the conducting filament (B) of the transmission line (A) can be steadily pressed and fixed firmly in place.

3. The large-area onto which the clamping piece 30 presses removes the defect possessed by conventional signal connectors, where the conventional screwing element (N) is directly rotated downward. When only pressing the central portion, without pressing two sides, of the conducting filament (B), this can result in poor electrical conduction.

4. The fish-eye insert hole 42 of the sleeve 4 of this invention is a little smaller than the screwing element 32. Therefore, the screwing element 32 can be fully fixed in place within the accommodating groove 20.

5. The clamping piece 30 of this invention is received into the accommodating groove 20. Therefore, when operated, the clamping piece 30 can only be moved upward but cannot be rotated. This ensures great accuracy and convenience in operation.

6. Both the clamping piece 30 and the accommodating groove 20 of this invention function carry out clamping across a large area. As a result, this invention can be employed for tightly clamping and positioning fine conducting filament (B).

While the preferred embodiment of the invention has been described above, it will be recognized and understood that various modifications may be made therein, and the appended claims are intended to cover all such modifications that may fall within the spirit and scope of the invention.

What is claimed is:

1. A signal connector comprising:

a main body being cylinder-shaped, said main body formed with a hollow accommodating groove, said main body having one end with a flange and an end connector, said accommodating groove formed with a threaded hole and an insert hole, said accommodating groove having two sides formed into a planar shape;

a positioning device received in said accommodating groove of said main body, said positioning device containing a clamping piece and screwing elements, said clamping piece having a surface provided with non-slip elements and one end bored with a threaded hole, said clamping piece being somewhat smaller than said accommodating groove in width, said screwing element inserted through said insert hole of said main body and screwed into said threaded hole of said clamping piece to have said clamping piece combined in said accommodating groove of said main body; and a sleeve covered around an outer side of said main body, said sleeve formed therein with an accommodating groove whose shape is the same as said main body, said sleeve provided with two fish-eye insert holes respectively corresponding with said threaded hole and said insert hole of said main body, said sleeve having a flange provided with an axial insert hole and a polar color ring.

2. The signal connector as claimed in claim 1, wherein said fish-eye insert hole of said sleeve is a little smaller than a head of said screwing element to enable both said screwing element and said clamping piece to be stabilized in said accommodating groove of said main body.

3. The signal connector as claimed in claim 1, wherein said positioning device can only be moved up and down in said accommodating groove of said main body, said positioning device able to be easily moved up and down by means of said screwing element.

4. The signal connector as claimed in claim 1, wherein said positioning device can only be moved up and down in said accommodating groove of said main body, with said screwing element facilitating movement up and down.

5. The signal connector as claimed in claim 1, wherein said clamping piece is provided with a non-slip surface that helps attain a better clamping effect.

* * * * *